US008622576B2

(12) United States Patent
Zhang

(10) Patent No.: US 8,622,576 B2
(45) Date of Patent: Jan. 7, 2014

(54) ICICLE-SHAPED BULB AND STRING LIGHT HAVING MULTIPLE OF THE SAME

(75) Inventor: Cheng-Chun Zhang, Kaohsiung (TW)

(73) Assignee: Gemmy Industries Corporation, Coppell, TX (US)

( * ) Notice: Subject to any disclaimer, the term of this patent is extended or adjusted under 35 U.S.C. 154(b) by 310 days.

(21) Appl. No.: 13/190,168

(22) Filed: Jul. 25, 2011

(65) Prior Publication Data

US 2013/0027940 A1 Jan. 31, 2013

(51) Int. Cl.
*F21V 21/008* (2006.01)
*F21V 3/02* (2006.01)

(52) U.S. Cl.
USPC ..... 362/249.02; 362/249.06; 362/363; 362/391

(58) Field of Classification Search
USPC ..... 362/249.02, 249.06, 249, 14, 249.14, 362/391, 235, 363, 806, 223, 217.02
See application file for complete search history.

(56) References Cited

U.S. PATENT DOCUMENTS

| | | | | |
|---|---|---|---|---|
| 6,224,239 | B1 * | 5/2001 | Adler | 362/249.16 |
| 6,394,624 | B1 * | 5/2002 | Hsu | 362/249.01 |
| 6,971,768 | B1 * | 12/2005 | Pepito et al. | 362/238 |
| 2006/0164831 | A1 * | 7/2006 | Lai | 362/231 |
| 2009/0175033 | A1 * | 7/2009 | Chien | 362/183 |

* cited by examiner

*Primary Examiner* — Thomas Sember
(74) *Attorney, Agent, or Firm* — Ming Chow; Sinorica, LLC

(57) ABSTRACT

A string light has multiple icicle-shaped bulbs, a controller and a connector assembly. The icicle-shaped bulbs are serially connected by a set of wires. Each icicle-shaped bulb has an icicle-shaped lamp holder shell, an elongated lamp strip and a cap assembly. The lamp holder shell has an irregular and rough surface and an opening. The lamp strip is mounted inside the lamp holder shell. The cap assembly is mounted on the opening of the lamp holder shell and has a set of through holes for the set of wires to penetrate into the lamp holder shell. Accordingly, light emitted from each icicle-shaped bulb is scattered irregularly to generate different illuminating effects when the icicle-shaped bulb is powered on and make the lighting variations of the entire string light more versatile and interesting.

6 Claims, 5 Drawing Sheets

ICICLE-SHAPED BULB AND STRING LIGHT HAVING MULTIPLE OF THE SAME

BACKGROUND OF THE INVENTION

1. Field of the Invention

The present invention relates to an ornamental string light, and more particularly to a string light having multiple icicle-shaped bulbs.

2. Description of the Related Art

Ornamental string lights are widely used for occasions such as balls, parties, exhibitions, festivals and holidays to serve for the purpose of decoration and create resplendent and glamorous atmosphere. To attract participants' attention and raise people's interest in participating in such occasions, the ornamental string lights are preferred to have rich color and brightness variations, which have become a crucial criterion for which the ornamental light industry is eager to pursue.

Each ornamental string light has multiple bulbs serially connected by a set of wires and the set of wires is electrically connected to a controller so that the controller can control the bulbs to blink or switch on or off so as to generate lighting variations of the bulbs. For sake of mass production and standardization, the bulbs, the shapes of the string lights look similarly and the richness in terms of color and brightness variations of the bulbs and the string lights is mitigated. As a consequence, the resulting light and brightness variations of the bulbs and the string light are insipid and dull and fail to capture people's attention.

SUMMARY OF THE INVENTION

An objective of the present invention is to provide a string light having multiple icicle-shaped bulbs for enhancing light-scattering effect.

To achieve the foregoing objective, the string light having multiple icicle-shaped bulbs has multiple icicle-shaped bulbs, a controller and a connector assembly.

The icicle-shaped bulbs are serially connected by a set of wires. Each icicle-shaped bulb has an icicle-shaped lamp holder shell, an elongated lamp strip and a cap assembly. The icicle-shaped lamp holder shell has an irregular and rough surface and an opening formed through a top of the lamp holder shell. The elongated lamp strip is mounted inside the lamp holder shell for the set of wires to be electrically connected thereto and has multiple light-emitting diode lamps mounted thereon. The cap assembly is mounted on the opening of the lamp holder shell and has a set of through holes for the set of wires to penetrate into the lamp holder shell through the set of through holes.

The controller is electrically connected to the icicle-shaped bulbs through the set of wires.

The connector assembly is electrically connected to the controller.

The irregular and rough surface on the icicle-shaped lamp holder shell of the icicle-shaped bulb gives rise to an irregularly-scattering effect on light emitted from each LED lamp on the lamp strip when the icicle-shaped bulb is powered on. Furthermore, the controller can control the icicle-shaped bulbs to blink or switch on or off to make the lighting variations of the entire string light more versatile and interesting.

Other objectives, advantages and novel features of the invention will become more apparent from the following detailed description when taken in conjunction with the accompanying drawings.

DETAILED DESCRIPTION OF THE INVENTION

Figure 1:
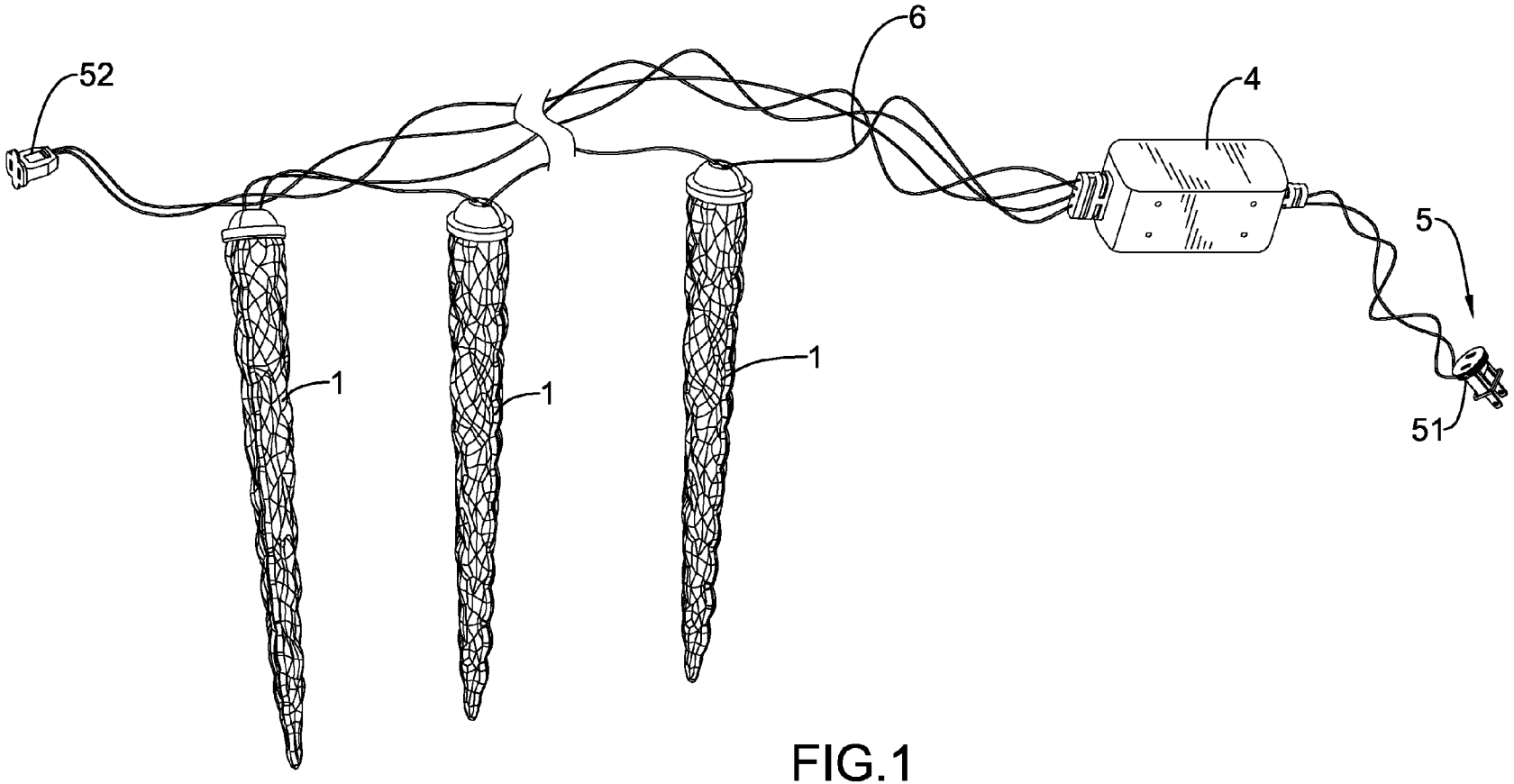
FIG. 1 is a perspective view of a string light having multiple icicle-shaped bulbs in accordance with the present invention.
Figure 2:
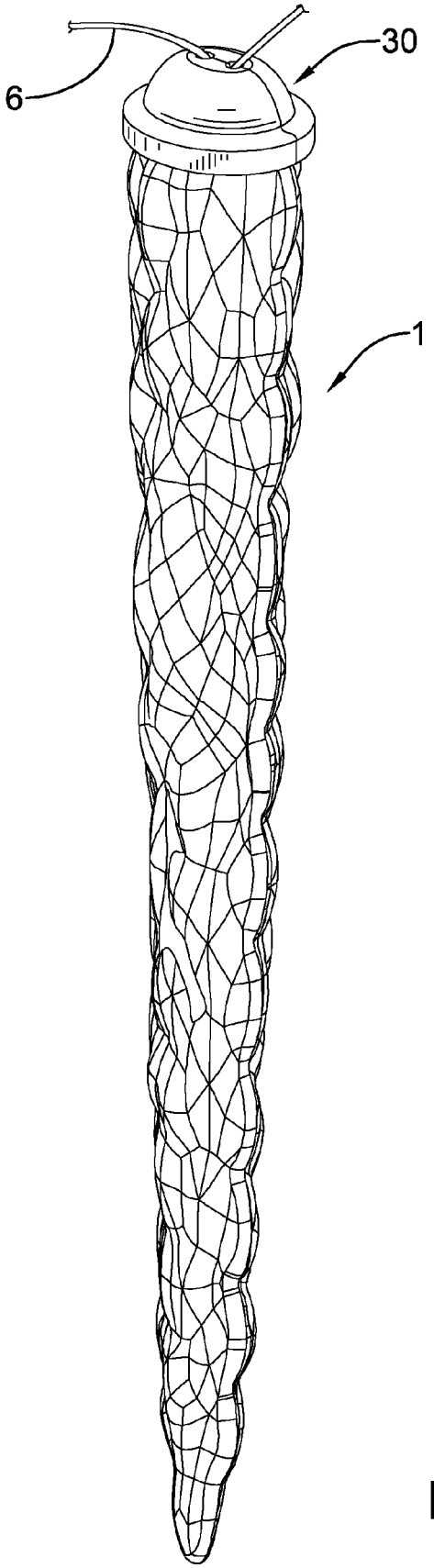
FIG. 2 is a perspective view of an icicle-shaped bulb in accordance with the present invention.
Figure 3:
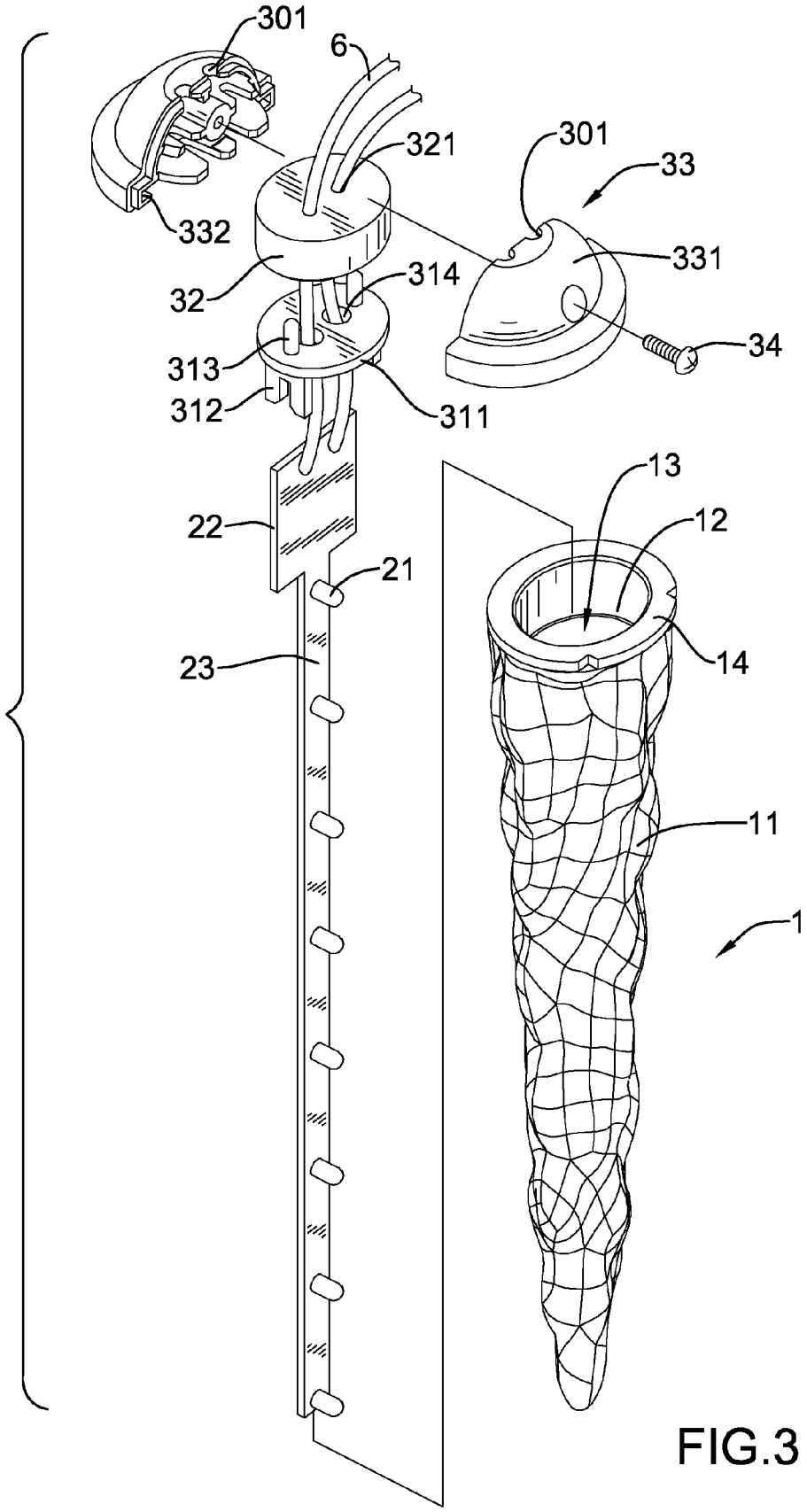
FIG. 3 is an exploded perspective view of the icicle-shaped bulb in FIG. 2.
Figure 4:
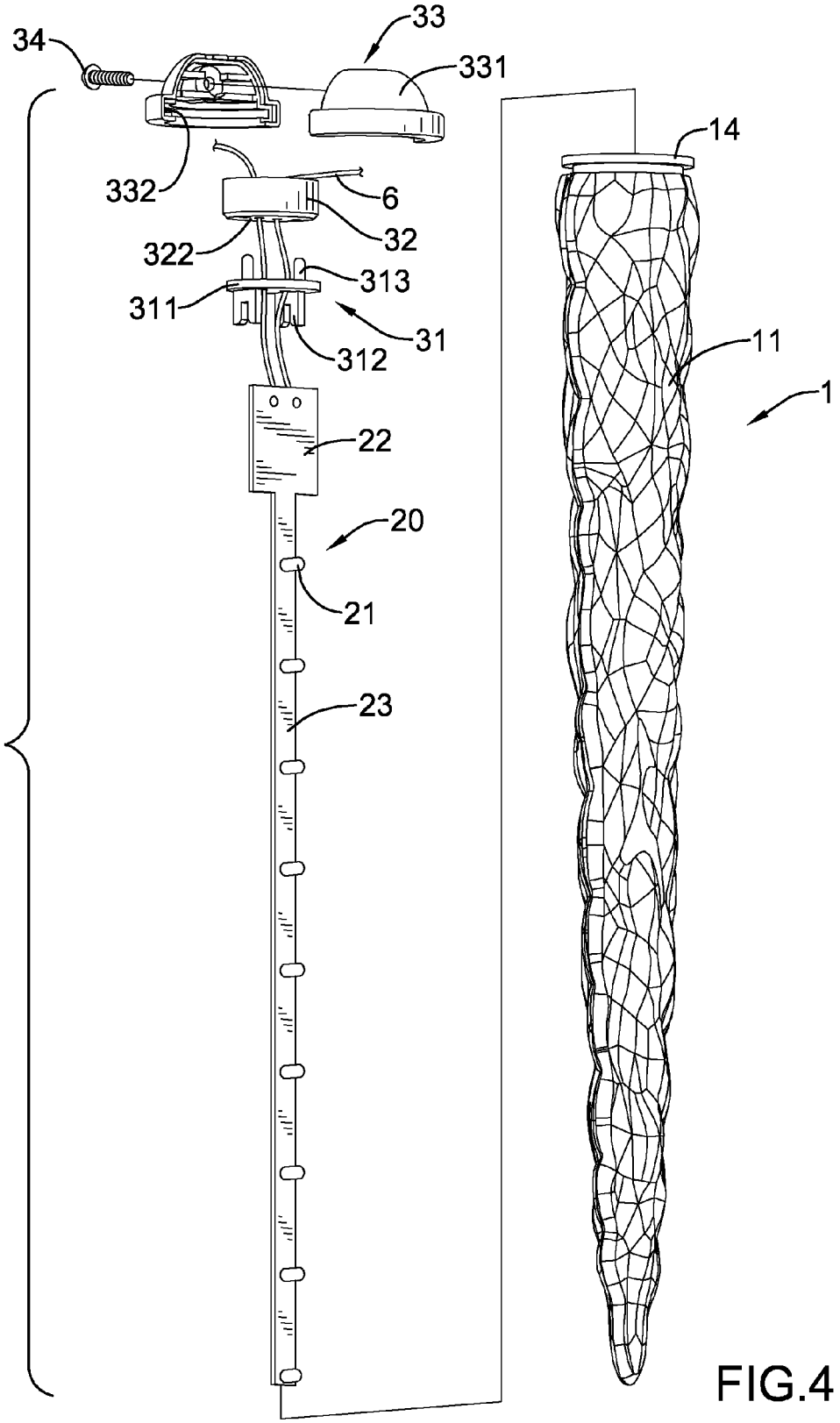
FIG. 4 is another exploded perspective view of the icicle-shaped bulb in FIG. 2.
Figure 5:
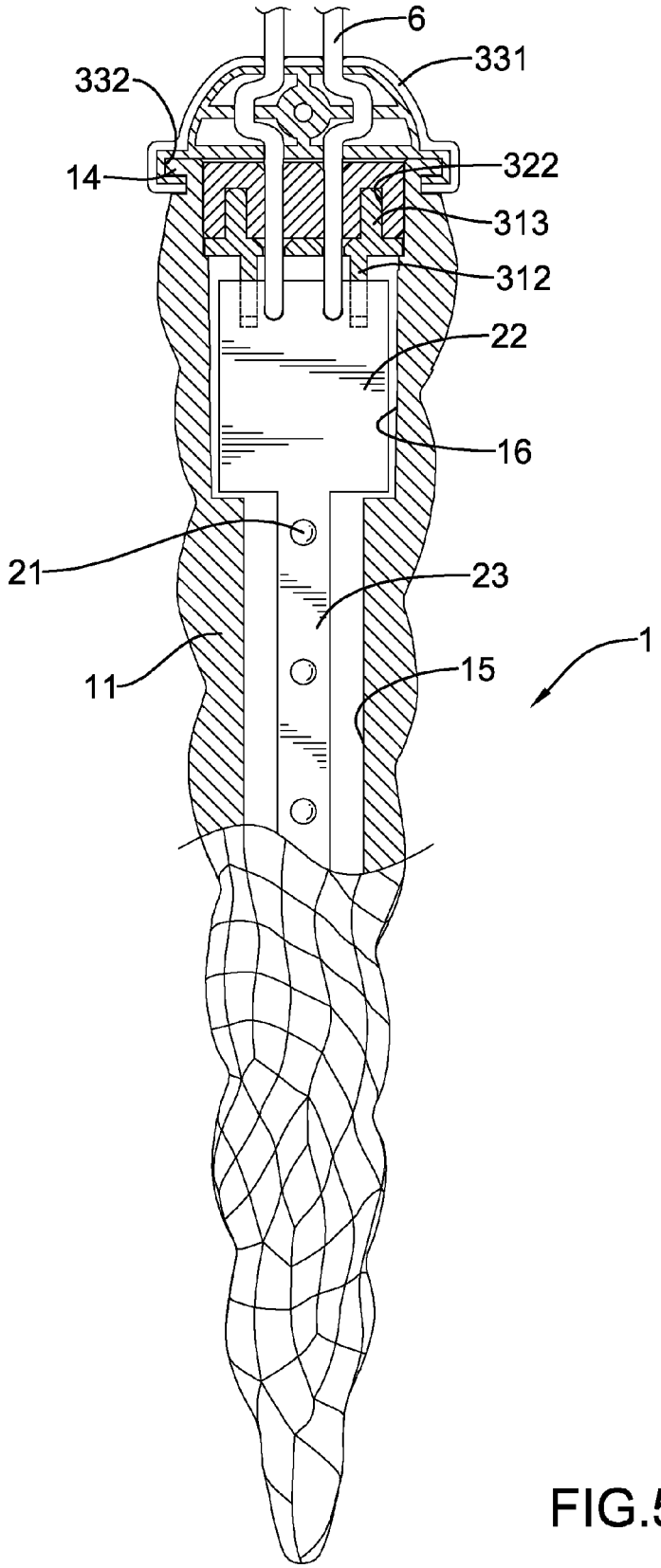
FIG. 5 is a front view in partial division of the icicle-shaped bulb in FIG. 2.

With reference to FIG. 1, a string light having multiple icicle-shaped bulbs in accordance with the present invention has multiple icicle-shaped bulbs 1, a controller 4 and a connector assembly 5. The icicle-shaped bulbs 1 are serially connected by a set of wires 6. The controller 4 is electrically connected to the icicle-shaped bulbs 1 through the set of wires 6. The connector assembly 5 is electrically connected to the controller 4. In the present embodiment, the connector assembly 5 has a plug 51 and a socket 52. The plug 51 serves to be inserted in an AC power socket or the socket 52 of another string light so that multiple string lights can be serially connected.

With reference to FIGS. 2 to 5, each icicle-shaped bulb 1 has an icicle-shaped lamp holder shell 11, an elongated lamp strip 20 and a cap assembly 30.

The icicle-shaped lamp holder shell 11 has an irregular and rough surface and an opening 12 formed through a top of the lamp holder shell 11. In the present embodiment, the lamp holder shell 11 further has a ring 14 and a cavity 13. The ring 14 is mounted on a rim of the opening 12. The cavity 13 has a reduced chamber 15 and an expanded chamber 16. The reduced chamber 15 and the expanded chamber 16 are cylindrical. The reduced chamber 15 is smaller than the expanded chamber 16 in diameter, and adjoins and communicates with the expanded chamber 16.

The elongated lamp strip 20 is mounted inside the lamp holder shell 11 for the set of wires 6 to be electrically connected thereto and has multiple LED lamps 21 mounted thereon. In the present embodiment, the elongated lamp strip 20 has a wide portion 22 and a slender portion 23. The wide portion 22 and the slender portion 23 are rectangular. The wide portion 22 has a width being larger than the diameter of the reduced chamber 15 of the cavity 13 and is mounted inside the expanded chamber 16 of the cavity 13. The slender portion 23 has a width being smaller than the diameter of the reduced chamber 15 of the cavity 13, is formed on and protrudes downwardly from a bottom of the wide portion 22, is mounted inside the reduced chamber 15 of the cavity 13, and has the LED lamps 21 mounted thereon.

The cap assembly 30 is mounted on the opening 12 of the lamp holder shell 11 and has a set of through holes 301 formed through a top of the cap assembly 30 for the set of wires 6 to penetrate into the lamp holder shell 11 through the set of through holes 301. In the present embodiment, the cap assembly 30 has a lamp strip seat 31, a soft plug 32 and a cap 33. The lamp strip seat 31 has a base 311, two strip holders 312 and two positioning pins 313. The base 311 has a set of through holes 314 formed through the base 311 for the set of wires 6 to penetrate through. The strip holders 312 are inverted U-shaped, are formed on and protrude downwardly from a bottom of the base 311 with the open ends of the strip holders 312 facing down so as to hold the wide portion 22 of the lamp strip 20. The positioning pins 313 are formed on and protrude upwardly from a top of the base 311. The soft plug 32 is cylindrical and made from a waterproof material, has a diameter corresponding to a diameter of the opening 12 of the lamp holder shell 11, is plugged in the opening 12 of the lamp holder shell 11, and has a set of through holes 321 and two pits 322. The set of through holes 321 serves for the set of wires 6 to penetrate through. Each pit 322 is formed in a bottom of the soft plug 32 and has a depth commensurate with a length of a corresponding positioning pin 313 for the positioning pin 313 to be inserted therein so that the soft plug 32 can be positioned on the top of the base 311. The cap 33 is disc-shaped, and has two halves 331 joined together. Each half has an annular slot 332 annularly and outwardly formed in a bottom of the half for the ring 14 of the lamp holder shell 11 to be slidably mounted in the annular slot 332. A bolt 34 is mounted through the two halves 331 to fasten the two halves 331 together.

When the icicle-shaped bulb 1 is assembled, the set of wires 6 sequentially penetrates through the set of through holes 321 of the soft plug 32 and the set of through holes 314 of the lamp strip seat 31 and then is electrically connected to the elongated lamp strip 20. The lamp strip 20 is mounted in the cavity 13 of the icicle-shaped lamp holder shell 11 through the opening 12 of the lamp holder shell 11. The slender portion 23 of the lamp strip 20 is mounted in the reduced chamber 15 of the cavity 13. The lamp strip seat 31 is mounted on a top edge of the lamp strip 20 to hold the wide portion 22 of the lamp strip 20. The soft plug 32 is plugged in the opening 12 of the icicle-shaped lamp holder shell 11 to seal the lamp strip 20 inside the icicle-shaped lamp holder shell 11 and prevent the lamp strip 20 from being damaged by water or moisture permeating into the icicle-shaped lamp holder shell 11. The annular slots 332 of the two halves 331 of the cap 33 align with the ring 14 of the icicle-shaped lamp holder shell 11 so that the ring 14 can be slidably mounted inside the annular slots 332 of the two halves 331 of the cap 33. The bolt 34 is mounted through the two halves 331 of the cap 33 to fasten the two halves 331 in completion of the assembly of the icicle-shaped bulb 1.

Due to the irregular and rough surface on the icicle-shaped lamp holder shell 11 of the icicle-shaped bulb 1, light emitted from each LED lamp 21 on the lamp strip 20 is scattered irregularly to generate different illuminating effects when the icicle-shaped bulb is powered on. Additionally, the controller 4 can control the icicle-shaped bulbs 1 to blink or switch on or off to make the lighting variations of the entire string light more versatile and interesting.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A string light having multiple icicle-shaped bulbs comprising:

multiple icicle-shaped bulbs serially connected by a set of wires, each icicle-shaped bulb having:

an icicle-shaped lamp holder shell having:

an irregular and rough surface;

an opening formed through a top of the lamp holder shell; and a cavity having:

a reduced chamber being cylindrical; and an expanded chamber being cylindrical, adjoining and communicating with the reduced chamber, wherein a diameter of the expander chamber is larger than a diameter of the reduced chamber;

an elongated lamp strip mounted inside the lamp holder shell for the set of wires to be electrically connected thereto and having:

multiple light-emitting diode (LED) lamps mounted thereon;

a wide portion having a width being larger than the diameter of the reduced chamber of the cavity and mounted inside the expanded chamber of the cavity; and a slender portion having a width being smaller than the diameter of the reduced chamber of the cavity, formed on and protruding downwardly from a bottom of the wide portion, mounted inside the reduced chamber of the cavity, and having the LED lamps mounted thereon; and a cap assembly mounted on the opening of the lamp holder shell and having a set of through holes for the set of wires to penetrate into the lamp holder shell through the set of through holes;

a controller electrically connected to the icicle-shaped bulbs through the set of wires; and a connector assembly electrically connected to the controller.

2. The string light as claimed in claim 1, wherein the lamp holder shell further has a ring mounted on a rim of the opening; and the cap assembly further has:

a lamp strip seat having:

a base having a set of through holes formed through the base for the set of wires to penetrate through;

two strip holders being inverted U-shaped, formed on and protruding downwardly from a bottom of the base with open ends of the strip holders facing down so as to hold the wide portion of the lamp strip; and two positioning pins formed on and protruding upwardly from a top of the base;

a soft plug being cylindrical and made from a waterproof material, having a diameter corresponding to a diameter of the opening of the lamp holder shell, plugged in the opening of the lamp holder shell, and having:

a set of through holes serving for the set of wires to penetrate through; and two pits, each pit formed in a bottom of the soft plug and having a depth commensurate with a length of a corresponding positioning pin for the positioning pin to be inserted therein so that the soft plug is positioned on the top of the base; and a cap being disc-shaped and having two halves joined and fastened together by a bolt, each half having an annular slot annularly and outwardly formed in a bottom of the half for the ring of the lamp holder shell to be slidably mounted in the annular slot.

3. The string light as claimed in claim 2, wherein the connector assembly has a plug and a socket.

4. The string light as claimed in claim 1, wherein the connector assembly has a plug and a socket.

5. An icicle-shaped bulb comprising:

an icicle-shaped lamp holder shell having:

an irregular and rough surface;

an opening formed through a top of the lamp holder shell; and a cavity having:

a reduced chamber being cylindrical; and an expanded chamber being cylindrical, adjoining and communicating with the reduced chamber, wherein a diameter of the expanded chamber is larger than a diameter of the reduced chamber; and an elongated lamp strip mounted inside the lamp holder shell for a set of wires to be electrically connected thereto and having:

multiple light-emitting diode (LED) lamps mounted thereon;

a wide portion having a width being larger than the diameter of the reduced chamber of the cavity and mounted inside the expanded chamber of the cavity; and a slender portion having a width being smaller than the diameter of the reduced chamber of the cavity, formed on and protruding downwardly from a bottom of the wide portion, mounted inside the reduced chamber of the cavity, and having the LED lamps mounted thereon; and a cap assembly mounted on the opening of the lamp holder shell and having a set of through holes for the set of wires to penetrate into the lamp holder shell through the set of through holes.

6. The icicle-shaped bulb as claimed in claim 5, wherein the lamp holder shell further has a ring mounted on a rim of the opening; and the cap assembly further has:

a lamp strip seat having:

a base having a set of through holes formed through the base for the set of wires to penetrate through;

two strip holders being inverted U-shaped, formed on and protruding downwardly from a bottom of the base with open ends of the strip holders facing down so as to hold the wide portion of the lamp strip; and two positioning pins formed on and protruding upwardly from a top of the base;

a soft plug being cylindrical, made from a waterproof material, having a diameter corresponding to a diameter of the opening of the lamp holder shell, plugged in the opening of the lamp holder shell, and having:

a set of through holes serving for the set of wires to penetrate through; and two pits, each pit formed in a bottom of the soft plug and having a depth commensurate with a length of a corresponding positioning pin for the positioning pin to be inserted therein so that the soft plug is positioned on the top of the base; and a cap being disc-shaped and having two halves joined and fastened together by a bolt, each half having an annular slot annularly and outwardly formed in a bottom of the half for the ring of the lamp holder shell to be slidably mounted in the annular slot.

* * * * *